US007510410B2

(12) United States Patent
Lin et al.

(10) Patent No.: US 7,510,410 B2
(45) Date of Patent: Mar. 31, 2009

(54) SUCKING COVER

(75) Inventors: Kuo-chin Lin, Tu-Cheng (TW); Feng Zhu, Tu-Cheng (TW); Hua-lian Li, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 31 days.

(21) Appl. No.: 11/806,277

(22) Filed: May 31, 2007

(65) Prior Publication Data

US 2008/0299786 A1 Dec. 4, 2008

(51) Int. Cl.
*H01R 13/44* (2006.01)

(52) U.S. Cl. ..... 439/135; 439/940

(58) Field of Classification Search ..... 439/135, 439/940, 41

See application file for complete search history.

(56) References Cited

U.S. PATENT DOCUMENTS 4,557,542 A * 12/1985 Coller et al. ..... 439/595
5,681,174 A * 10/1997 Correll et al. ..... 439/135
6,135,795 A * 10/2000 Ho et al. ..... 439/135
6,837,722 B2 * 1/2005 Sakamoto ..... 439/135
6,979,211 B1 * 12/2005 Shen ..... 439/135
7,033,189 B1 * 4/2006 Zhang et al. ..... 439/135
7,059,876 B2 * 6/2006 Zhang et al. ..... 439/135

* cited by examiner

*Primary Examiner*—Gary F. Paumen
(74) *Attorney, Agent, or Firm*—Rosenberg, Klein & Lee

(57) ABSTRACT

A sucking cover inserted into an electric connector with terminals received therein includes a sucking portion and an insertion portion. The sucking portion has a sucking surface at the front and a catching surface at the rear. A plane sucking area is formed as a portion of the sucking surface. The sucking surface is parallel with a bottom plate of the electric connector mounted on a PCB. The catching surface is against the top of the electric connector when the sucking cover is inserted into the electric connector. The inserted portion projected from the catching surface has an inserted wall and ribs. While the inserted portion is inserted into an inserted slot of the electric connector, the electric connector can be moved while the sucked cover is moved. In SMT, this action will improve the effective of the electric connector located in a PCB.

4 Claims, 3 Drawing Sheets

SUCKING COVER

BACKGROUND OF THE INVENTION

1. Field of the Invention

This present invention relates generally to a sucking cover used in the field of the printed circuit assemblies (PCA), and more particularly to a sucking cover sucking an electric connector which is bonded to a PCB by SMT (Surface Mount Technology).

2. The Related Art

The SMT is used in the electric assembly. While an element is inserted into a PCB and welded in the PCB, the element is sucked and drawn by a vacuum sucking apparatus to the PCB. If the surface of the element is not plane, the element will not be held by the vacuum sucking apparatus, so the element is not assembled in the PCB by SMT. If the element is located in the PCB by handwork, it is dangerous and inefficiency.

SUMMARY OF THE INVENTION

An object of the invention is to provide a sucking cover inserted into an electric connector with terminals received therein for helping a vacuum sucking apparatus sucking the electric connector. The sucking cover comprises a sucking portion and an insertion portion. The sucking portion has a sucking surface at the front and a catching surface at the rear, a plane sucking area is formed as a portion of the sucking surface. The sucking surface is parallel with a bottom plate of the electric connector for mounted on a PCB, the catching surface is against the top of the electric connector when the sucking cover is inserted into the electric connector. The inserted portion projects from the catching surface and has an inserted wall and a plurality of ribs. The inserted wall has a lower surface and an upper surface opposite to the lower surface. The ribs are arranged sidelong on the upper surface, the inserted wall is inserted into the recess and located between the terminals and a first inner surface of the recess apart from the terminals. The thickness of the rib is smaller than the distance between two adjacent terminals for being located between the two adjacent terminals. The ribs are against a second inner surface of the recess opposite to the first inner surface. The lower surface of the inserted wall is against the first inner surface.

In SMT, the vacuum sucking apparatus sucks the sucking surface and takes the sucking cover. While the electric connector is located on the PCB, the vacuum sucking apparatus separates from the sucking surface and can be used again, therefore it can save resource and reduce the production cost. Moreover, the sucking cover has a simple structure and then can be produced easily.

BRIEF DESCRIPTION OF THE DRAWINGS

The invention, together with its objects and the advantages thereof may be best understood by reference to the following description taken in conjunction with the accompanying drawings, in which.

DETAILED DESCRIPTION OF THE PREFERRED EMBODIMENT an embodiment of the present invention will be described below in detail with reference to the accompanying drawings. It goes without saying, however, that the present invention is not limited to the following embodiment and can be arbitrarily modified without departing from the scope and spirit of the present invention.

Figure 1:
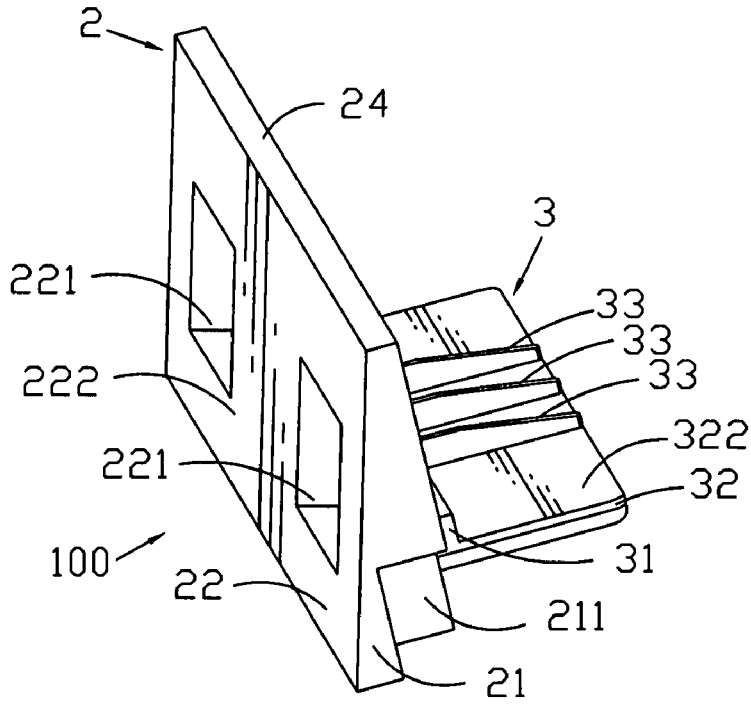
FIG. 1 is a schematic view showing a sucking cover according to the present invention.
Figure 2:
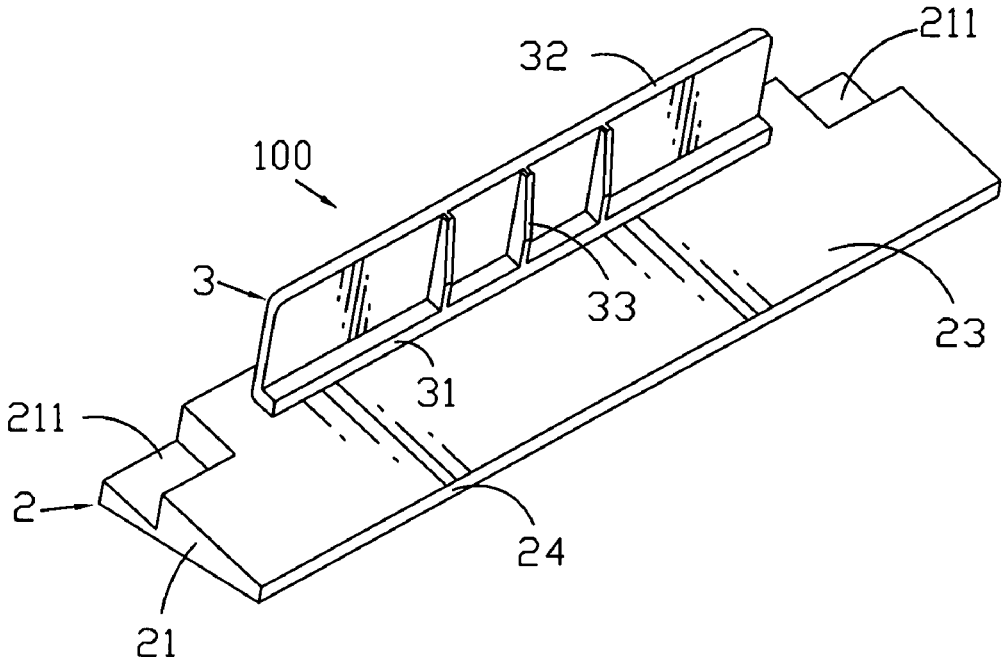
FIG. 2 is another schematic view of the sucking cover shown in FIG. 1.
Figure 3:
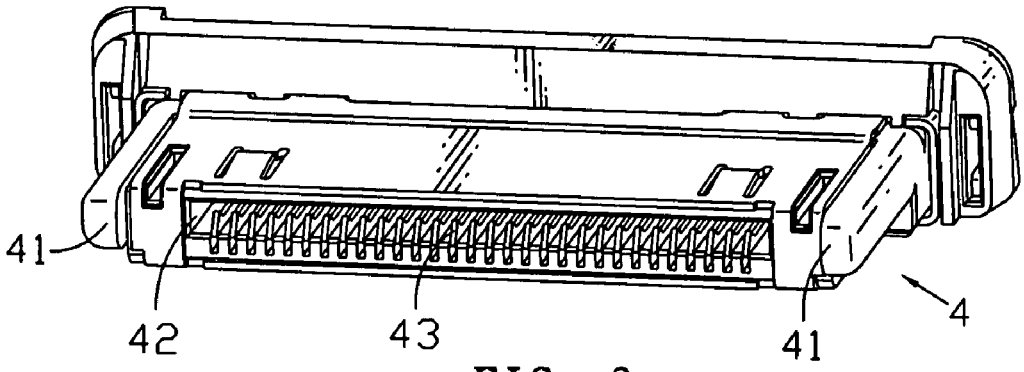
FIG. 3 is a schematic view showing an electric connector, which can be sucked by the sucking cover.
Figure 4:
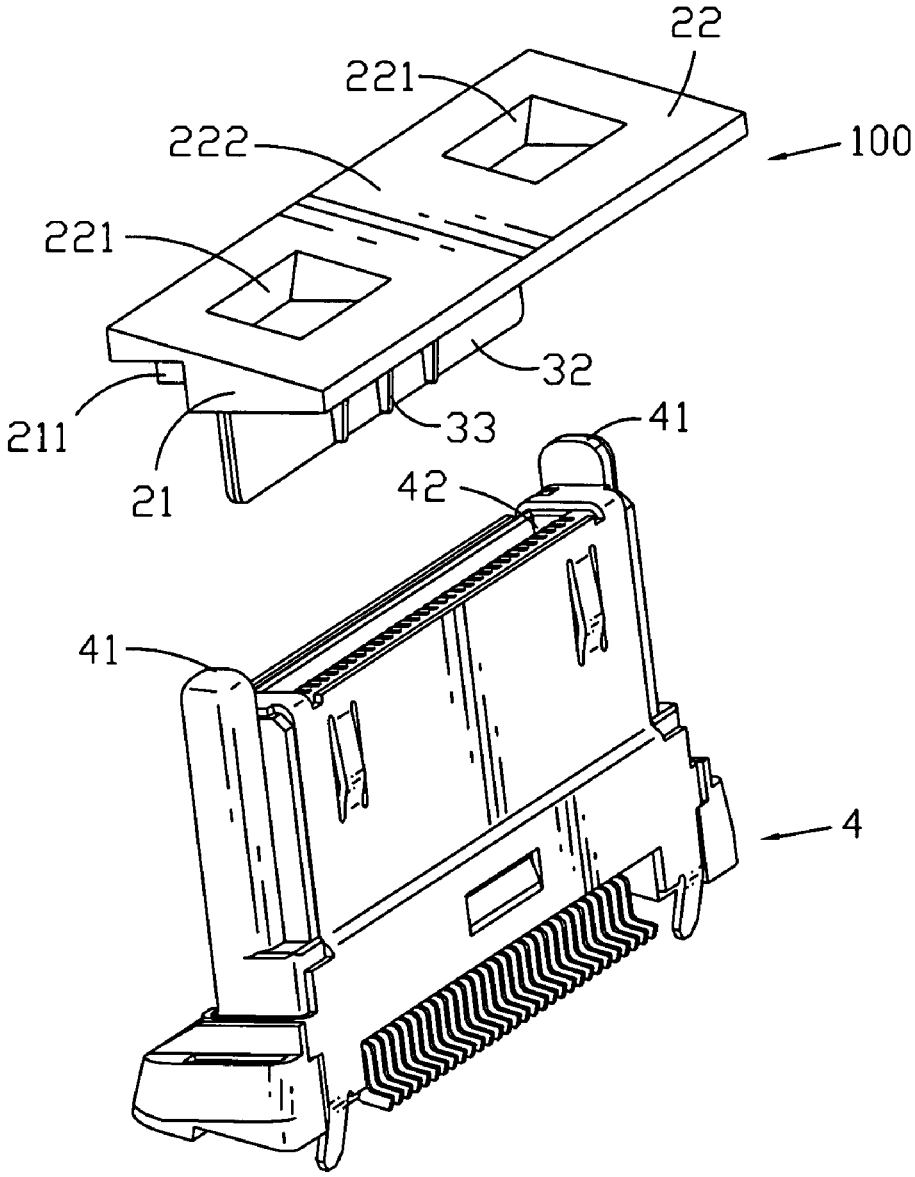
FIG. 4 is a schematic view showing the sucking cover will be inserted into the electric connector.
Figure 5:
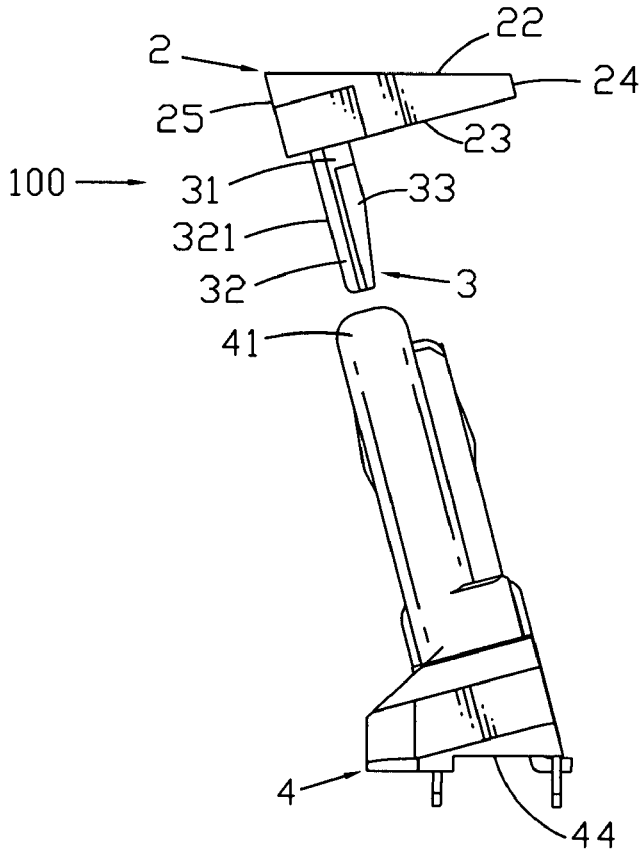
FIG. 5 is a side view of FIG. 4.
Figure 6:
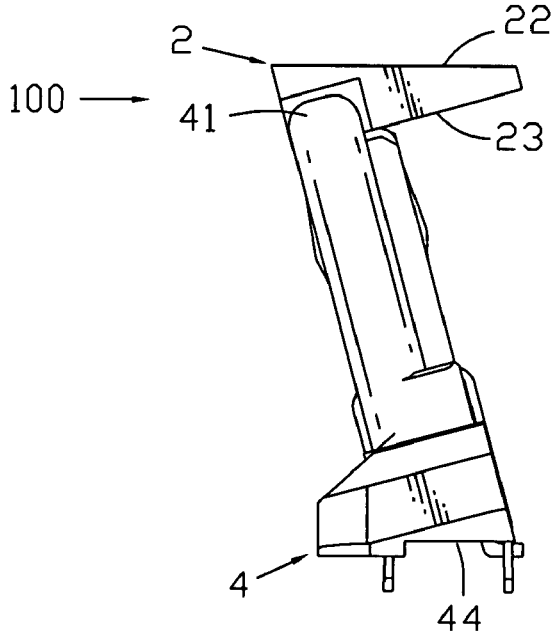
FIG. 6 is a schematic view showing the sucking cover assembled with the electric connector.

First referring to FIGS. 1 and 2 in accordance with the present invention, a sucking cover 100 is shown. The sucking cover 100 includes a sucking portion 2 and an inserted portion 3. Two end surfaces 21 are formed at two end of the sucking portion 2, a sucking surface 22 is formed at the front of the sucking portion 2, a catching surface 23 is formed at the back of the sucking portion 2, a top surface 24 and a bottom surface 25 extending lengthwise are formed at the top and the bottom of the sucking portion 2. The sidelong depth of the top surface 24 is less than that of the bottom surface 25. Two accepting recesses 211 are symmetrically arranged in the bottom of the two end surfaces 21. The accepting recess 211 shows a rectangle shape and passes through the catching surface 23 and the bottom surface 25.

The inserted portion 3 projects from the catching surface 23 and is near to the bottom surface 25 and between the two accepted accesses 211. The inserted portion 3 includes a base 31, an inserted wall 32 and three ribs 33. The base 31 is lengthwise formed on the catching surface 23. A lower portion of the base 31 protrudes backward to form the inserted wall 32, the inserted wall 32 has a lower surface 321 near to the bottom surface 25 and vertical with the catching surface 23, and an upper surface 322 parallel with the lower surface 321. The three ribs 33 are arranged sidelong on the upper surface 232, the space between the adjacent ribs 33 is equal. The height of the rib 33 is gradually reduced from the place of the rib 33 near to the catching surface 23 to the rear end of the rib 33.

The thickness of the sucking portion 2 is bigger than that of the inserted wall 3, two rectangle cavities 221 are opened and arranged lengthwise in the sucking surface 22 in order to prevent the sucking portion 2 shrinking to make the sucking surface 22 be not plane when the sucking cover 100 is molded. A sucking area 222 is formed on the sucking surface 22 and between the two rectangle cavities 221. A vacuum sucking apparatus can suck the sucking area 222 and move the sucking cover 100.

Referring to FIGS. 3-6, an electric connector 4 used in SMT is shown. Two raised lumps 41 are symmetrically arranged at two sides of the top of the electric connector 4, the raised lumps 41 match with the accepting recesses 211. A recess 42 is formed in the electric connector 4 and between the two raised lumps 41. A set of terminals 43 are accepted in the recess 42. The electric connector 4 has a bottom plate 44, when the inserted portion 3 of the sucking cover 100 is inserted into the electric connector 4 completely. The bottom plate 44 is parallel to the sucking area 222. The inserted wall 32 is inserted into the recess 42 and located between the terminals 43 and a first inner surface of the recess 42 apart from the terminals 43. The thickness of the rib 33 is smaller than the distance between two adjacent terminals 33, therefore the rib 33 is located between the two adjacent terminals 33. The ribs 33 are against a second inner surface of the recess 42 opposite to the first inner surface. The lower surface 321 of the inserted wall 32 is against the first inner surface. The inserted portion 3 is inserted into the recess 42. The raised lumps 41 are accepted in the accepting recesses 211. The top of the electric connector 4 is against the catching surface 23 of the sucking portion 2 when the inserted portion 3 is completely received in the recess 42.

In SMT, the vacuum sucking apparatus sucks the sucking surface 22 and takes the sucking cover 100. While the electric connector 4 is located on the PCB, the vacuum sucking apparatus separates from the sucking surface 22 and can be used again, therefore it can save resource and reduce the production cost. Moreover, the sucking cover 100 has a simple structure and then can be produced easily.

An embodiment of the present invention has been discussed in detail. However, this embodiment is merely a specific example for clarifying the technical contents of the present invention and the present invention is not to be construed in a restricted sense as limited to this specific example. Thus, the spirit and scope of the present invention are limited only by the appended claims.

What is claimed is:

1. A sucking cover, mating to an electric connector having a plurality of terminals for assisting the electric connector in being held to a printed circuit board (PCB) by a vacuum sucking apparatus, comprising:

a sucking portion, having a sucking surface at the front and a catching surface at the rear, a plane sucking area being formed as a portion of the sucking surface, the sucking surface being parallel with a bottom plate of the electric connector for being mounted on the PCB, the catching surface being against the top of the electric connector when the sucking cover is inserted into the electric connector; and an inserted portion, projecting from the catching surface and having an inserted wall and a plurality of ribs, the inserted wall having a lower surface and an upper surface opposite to the lower surface, the ribs being arranged sidelong on the upper surface, the inserted wall being inserted into a recess and located between the terminals and a first inner surface of the recess apart from the terminals, the ribs being against a second inner surface of the recess opposite to the first inner surface, the lower surface of the inserted wall being against the first inner surface.

2. The sucking cover as set forth in claim 1, further comprising two accepting recesses symmetrically arranged on a surface of the sucking portion for mating with corresponding raised lumps extending from two sides of the top of the electric connector.

3. The sucking cover as set forth in claim 1, wherein the inserted portion has a base which is lengthwise formed on the catching surface, the base protrudes backward to form the inserted wall.

4. The sucking cover as set forth in claim 1, wherein the height of the rib is gradually reduced from the catching surface to the rear end of the rib.

* * * * *